US012782022B2

(12) United States Patent
Li et al.

(10) Patent No.: US 12,782,022 B2
(45) Date of Patent: Nov. 3, 2026

(54) SYSTEM AND METHOD FOR DECOUPLING COMPRESSORS AND SWITCHING REFRIGERANT FLOW BASED ON AMBIENT TEMPERATURE

(71) Applicant: Heatcraft Refrigeration Products LLC, Stone Mountain, GA (US)

(72) Inventors: Daqing Li, Snellville, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 150 days.

(21) Appl. No.: 18/958,087

(22) Filed: Nov. 25, 2024

(65) Prior Publication Data

US 2026/0146772 A1 May 28, 2026

(51) Int. Cl.

| | |
|---|---|
| ***F25B 49/02*** | (2006.01) |
| ***F25B 40/00*** | (2006.01) |
| ***F25B 41/20*** | (2021.01) |
| ***F25B 41/42*** | (2021.01) |

(52) U.S. Cl.

CPC ..... *F25B 49/02* (2013.01); *F25B 40/00* (2013.01); *F25B 41/20* (2021.01); *F25B 41/42* (2021.01); *F25B 2600/2507* (2013.01); *F25B 2700/2104* (2013.01)

(58) Field of Classification Search

CPC ..... F25B 49/02; F25B 40/00; F25B 41/20; F25B 41/42; F25B 2600/2507; F25B 2700/2104; F25B 5/02; F25B 9/008; F25B 31/004; F25B 2400/0401; F25B 2400/05; F25B 2400/075; F25B 2400/13; F25B 2400/23; F25B 2500/29; F25B 1/10; F25B 2700/2106

See application file for complete search history.

(56) References Cited

U.S. PATENT DOCUMENTS

| | | | | |
|---|---|---|---|---|
| 2018/0274823 | A1* | 9/2018 | Rajendiran | F25B 5/02 |
| 2024/0011685 | A1* | 1/2024 | Sakthivel | F25B 41/20 |
| 2024/0151437 | A1* | 5/2024 | Shanmugam | F25B 9/008 |

* cited by examiner

*Primary Examiner* — Emmanuel E Duke
(74) *Attorney, Agent, or Firm* — Baker Botts L.L.P.

(57) ABSTRACT

A method for switching the flow path of refrigerant with decoupled compressors is disclosed. The method comprises receiving a detected ambient temperature from a temperature sensor circuit. The method further comprises determining whether the detected ambient temperature is less than a threshold ambient temperature. The method further comprises communicating a first electronic signal to a switching valve to direct a flow path of the refrigerant from the switching valve toward an outdoor heat exchanger in response to determining that the detected ambient temperature is less than the threshold ambient temperature. The method further comprises communicating a second electronic signal to the switching valve to direct the flow path of the refrigerant from the switching valve toward a flash tank in response to determining that the detected ambient temperature is more than or equal to the threshold ambient temperature.

20 Claims, 8 Drawing Sheets

100

SYSTEM AND METHOD FOR DECOUPLING COMPRESSORS AND SWITCHING REFRIGERANT FLOW BASED ON AMBIENT TEMPERATURE

TECHNICAL FIELD

This disclosure relates generally to refrigeration systems. More particularly, this disclosure relates to a system and method for decoupling compressors and switching refrigerant flow based on ambient temperature.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

Conventional carbon dioxide ($CO_2$) refrigeration systems may include a medium temperature and a low-temperature compressor. In some conventional refrigeration systems, the low-temperature compressor compresses refrigerant from the low-temperature section (e.g., freezers in a store), while the medium-temperature compressor handles a combination of refrigerants, including the low-temperature compressor's discharge, medium-temperature refrigerant (e.g., from display cases), and flash gas from the flash tank. In some $CO_2$ refrigeration systems, the pressure differential between the low-temperature and medium-temperature applications is larger compared to when other refrigerants are used. This large pressure difference makes it difficult for a single compressor to handle the compression of the $CO_2$ refrigerant. Typically, in some $CO_2$ refrigeration systems, two compressors are stacked or cascaded to handle the compression of the refrigerant. In the cascaded configuration, the outbound line of the low-temperature compressor is connected to the suction line of the medium-temperature compressor. In this configuration, both compressors usually operate in any condition because turning off the downstream compressor (e.g., medium-temperature compressor) would result in the upstream compressor (e.g., low-temperature compressor) to have no discharge path. Even in low ambient temperature conditions where only one compressor may be sufficient to handle the compression of the refrigerant, due to the cascaded nature of the compressors in conventional systems, they waste energy by running both compressors. Further, in conventional refrigeration systems, the medium-temperature compressor is tasked to handle multiple refrigerant streams simultaneously (i.e., refrigerant streams from the low-temperature compressor, from the medium-temperature evaporator, and from the flash tank). This adds complexity to the control of the flow of the refrigerant streams and makes the design and troubleshooting more difficult.

The disclosed system provides a solution to these and other technical problems of the conventional refrigeration systems. The disclosed refrigeration system is configured to decouple the two compressors so that they are independent of each other and can be operated independently. The disclosed system is configured to implement a switching valve to dynamically switch the flow path of the refrigerant based on the ambient temperature conditions. In low ambient temperature mode, the switching valve is controlled to direct the flow of the refrigerant from the low-temperature and medium-temperature compressor to the outdoor heat exchanger and bypass the flash tank vapor compressor. In high ambient temperature mode, the switching valve is controlled to direct the flow of the refrigerant from the low-temperature and medium-temperature compressor to the flash tank. In either mode, the medium-temperature compressor and the low-temperature compressor are decoupled and can be operated as needed based on the respective conditioning demand.

The disclosed system solves the issue of the medium-temperature compressor receiving and being burdened by multiple refrigerant streams simultaneously by separating the flow paths of the refrigerant streams. This, in turn, reduces the complexity to operate the system and the energy that would otherwise be spent by the medium-temperature compressor having been turned on every time the low-temperature compressor is turned on.

The disclosed system is configured to implement the flash tank vapor compressor to increase the efficiency of managing the vapor refrigerant. Specifically, in the high ambient temperature mode, the vapor refrigerant from the flash tank flows to the flash tank vapor compressor (via a suction heat exchanger) to compress the vapor to a higher pressure. Then, the gaseous refrigerant from the flash tank vapor compressor flows to the outdoor heat exchanger to release the absorbed heat to the outdoor environment. This loop allows the vapor refrigerant not to be accumulated in the flash tank and liquid refrigerant to be more readily available to be provided to the low-temperature evaporator and medium-temperature evaporator compared to the traditional refrigeration systems where the medium-temperature compressor is also tasked with managing the vapor refrigerant from the flash tank as well as compressing the refrigerant from a medium-temperature evaporator. In some embodiments, the refrigeration system comprises a temperature sensor circuit configured to detect an ambient temperature within a vicinity of the refrigeration system. The refrigeration system further comprises a first low-temperature or medium-temperature evaporator positioned downstream of a flash tank and configured to absorb heat from surrounding environment via refrigerant received from the flash tank. The refrigeration system further comprises a first low-temperature or medium temperature compressor positioned downstream of the first low-temperature or medium temperature evaporator, and configured to compress the refrigerant received from the first low-temperature or medium-temperature evaporator. The refrigeration system further comprises an oil separator positioned downstream of the first low-temperature or medium-temperature compressor, and configured to separate oil from the refrigerant received from the first low-temperature or medium temperature compressor and return the separated oil to the first low-temperature or medium temperature compressor. The refrigeration system further comprises a switching valve positioned downstream of the oil separator, and configured to selectively switch a flow path of the refrigerant between the flash tank and an outdoor heat exchanger depending on the detected ambient temperature.

The refrigeration system further comprises a controller, communicatively coupled with the temperature sensor circuit and the switching valve. The controller comprises a processor configured to receive the detected ambient temperature from the temperature sensor circuit. The processor is further configured to determine whether the detected ambient temperature is less than a threshold ambient temperature. The processor is further configured to communicate a first electronic signal to the switching valve to direct the flow path of the refrigerant from the switching valve toward the outdoor heat exchanger in response to determining that the detected ambient temperature is less than the threshold ambient temperature. The processor is further configured to communicate a second electronic signal to the switching valve to direct the flow path of the refrigerant from the switching valve toward the flash tank in response to determining that the detected ambient temperature is more than or equal to the threshold ambient temperature.

Certain embodiments of the present disclosure may include some or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1A:
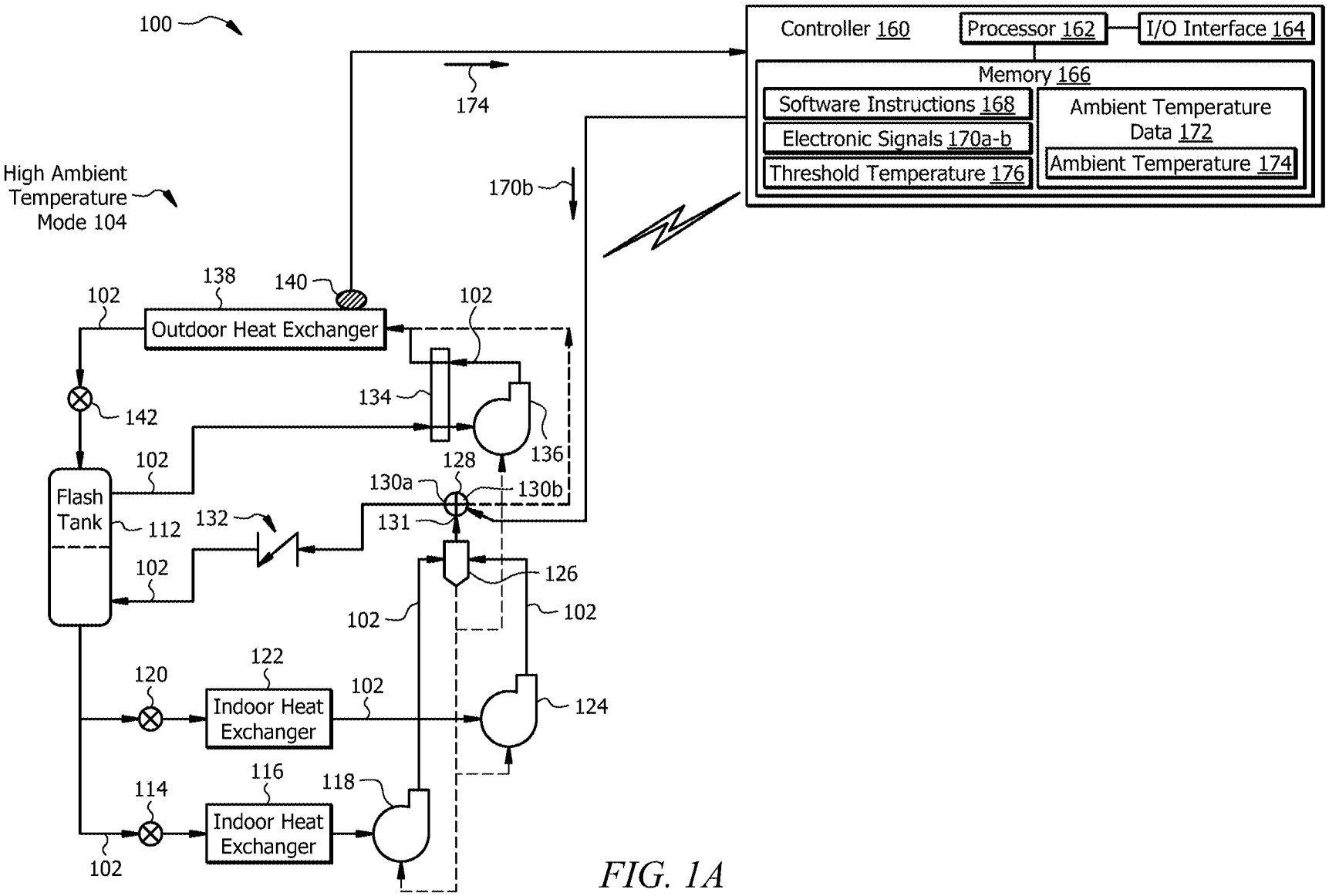
FIGS. 1A and 1B illustrate an embodiment of a refrigeration system configured to provide control the flow of refrigerant based on ambient temperature and provide a low temperature conditioning and a medium temperature conditioning, respectively.

Embodiments of the present disclosure and its advantages are best understood by referring to FIGS. 1A through 5 of the drawings, like numerals being used for like and corresponding parts of the various drawings.

Conventional carbon dioxide ($CO_2$) refrigeration systems may include a medium temperature and a low-temperature compressor. In some conventional refrigeration systems, the low-temperature compressor compresses refrigerant from the low-temperature section (e.g., freezers in a store), while the medium-temperature compressor handles a combination of refrigerants, including the low-temperature compressor's discharge, medium-temperature refrigerant (e.g., from display cases), and flash gas from the flash tank. In some $CO_2$ refrigeration systems, the pressure differential between the low-temperature and medium-temperature applications is larger compared to when other refrigerants are used. This large pressure difference makes it difficult for a single compressor to handle the compression of the $CO_2$ refrigerant. Typically, in $CO_2$ refrigeration systems, two compressors are stacked or cascaded to handle the compression of the refrigerant. In the cascaded configuration, the outbound line of the low-temperature compressor is connected to the suction line of the medium-temperature compressor. In this configuration, both compressors usually operate in any condition because turning off the downstream compressor (e.g., medium-temperature compressor) would result in the upstream compressor (e.g., low-temperature compressor) to have no discharge path. Even in low ambient temperature conditions where only one compressor may be sufficient to handle the compression of the refrigerant, due to the cascaded nature of the compressors in conventional systems, they waste energy by running both compressors. Further, in conventional refrigeration systems, the medium-temperature compressor is tasked to handle multiple refrigerant streams simultaneously (i.e., refrigerant streams from the low-temperature compressor, from the medium-temperature evaporator, and from the flash tank). This adds complexity to the control of the flow of the refrigerant streams and makes the design and troubleshooting more difficult.

The disclosed system provides a solution to these and other technical problems of the conventional refrigeration systems. The disclosed refrigeration system is configured to decouple the two compressors so that they are independent of each other and can be operated independently. The disclosed system is configured to implement a switching valve to dynamically switch the flow path of the refrigerant based on the ambient temperature conditions. In low ambient temperature mode, the switching valve is controlled to direct the flow of the refrigerant from the low-temperature and/or medium-temperature compressor to the outdoor heat exchanger and bypass the flash tank vapor compressor. In high ambient temperature mode, the switching valve is controlled to direct the flow of the refrigerant from the low-temperature and/or medium-temperature compressor to the flash tank. In either mode, the medium-temperature compressor and the low-temperature compressor are decoupled and can be operated as needed based on the respective conditioning demand.

The disclosed system solves the issue of the medium-temperature compressor receiving and being burdened by multiple refrigerant streams simultaneously by separating the flow paths of the refrigerant streams. This, in turn, reduces the complexity to operate the system and the energy that would otherwise be spent by the medium-temperature compressor having been turned on every time the low-temperature compressor is turned on.

The disclosed system is configured to implement the flash tank vapor compressor to increase the efficiency of managing the vapor refrigerant. Specifically, in the high ambient temperature mode, the vapor refrigerant from the flash tank flows to the flash tank vapor compressor (via a suction heat exchanger) to compress the vapor to a higher pressure. Then, the gaseous refrigerant from the flash tank vapor compressor flows to the outdoor heat exchanger to release the absorbed heat to the outdoor environment. This loop allows the vapor refrigerant not to be accumulated in the flash tank and liquid refrigerant to be more readily available to be provided to the indoor heat exchangers compared to the traditional refrigeration systems where the medium-temperature compressor is also tasked with managing the vapor refrigerant from the flash tank as well as compressing the refrigerant from a medium-temperature indoor heat exchanger.

Refrigeration System

Figure 1B:
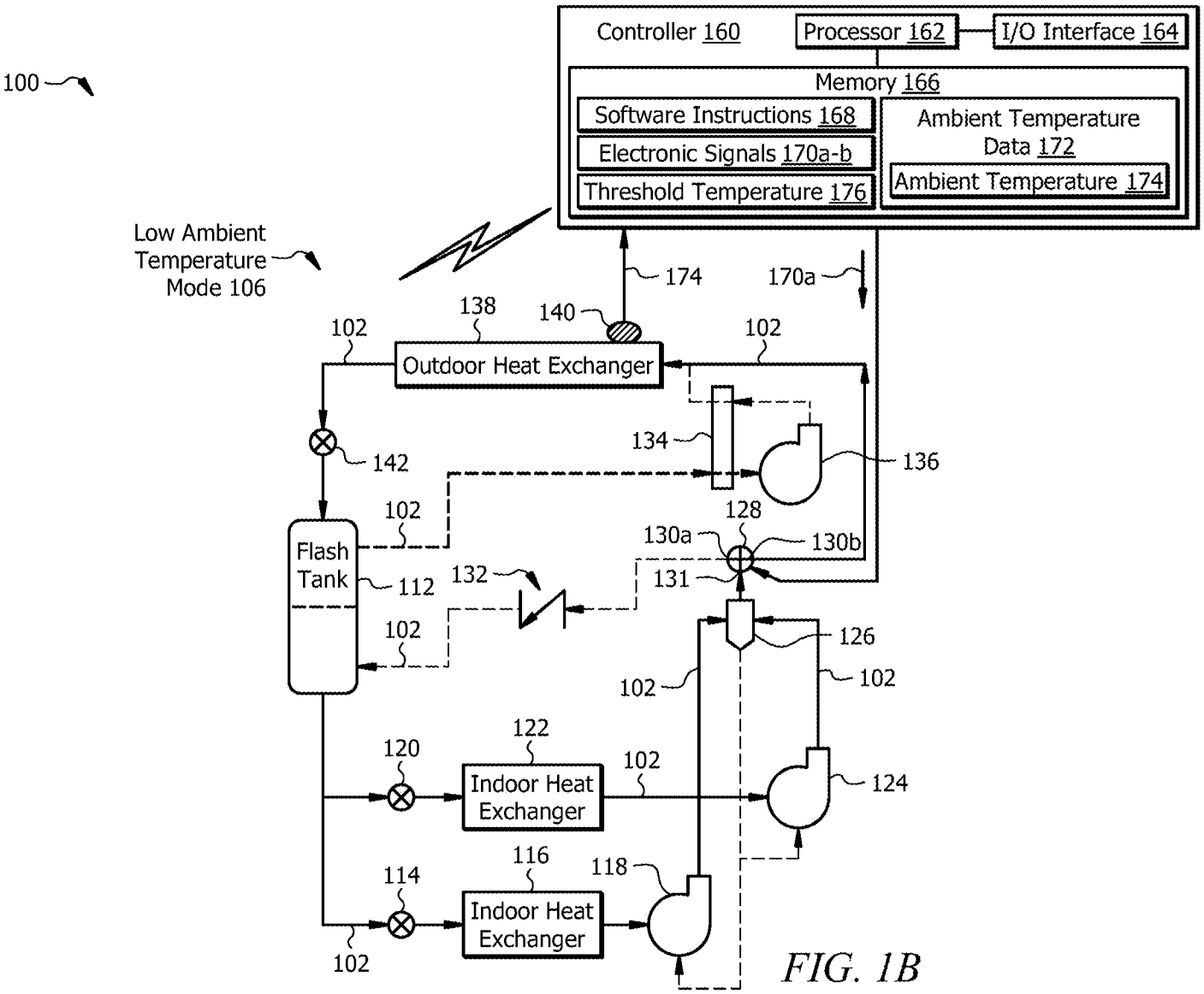

FIGS. 1A and 1B illustrate an example refrigeration system 100 operating in a high ambient temperature mode and a low ambient temperature mode, respectively, according to an embodiment of the present disclosure. In general, the refrigeration system 100 is configured to control the flow of refrigerant via a switching valve 128 based on the ambient temperature 174. In some embodiments, the refrigeration system 100 comprises a flash tank 112, a valve 114, a first indoor heat exchanger 116, a first compressor 118, a valve 120, a second indoor heat exchanger 122, a second compressor 124, an oil separator 126, the switching valve 128, a check valve 132, a suction heat exchanger 134, a flash tank vapor (FTV) compressor 136, an outdoor heat exchanger 138, a temperature sensor circuit 140, a valve 142, and a controller 160. In some embodiments, the refrigeration system 100 is a transcritical refrigeration system that circulates a working fluid, such as a transcritical refrigerant (e.g., $CO_2$). The illustrated embodiment of the refrigeration system 100 in FIGS. 1A and 1B is configured to provide two distinct cooling conditioning, 1) via the first indoor heat exchanger 116 (e.g., for freezing applications) and 2) via the second indoor heat exchanger 122 (e.g., for refrigeration applications).

FIG. 1A illustrates the flow of the refrigerant through the refrigeration system 100 operating in a high ambient temperature mode 104. In The refrigerant conduit subsystems 102 through which the refrigerant flows to operate the refrigeration system 100 in a high ambient temperature mode 104 are shown with solid lines, and other refrigerant conduit subsystems 102 that are not in use are shown with dash lines.

FIG. 1B illustrates the flow of the refrigerant through the refrigeration system 100 operating in a low ambient temperature mode 106. The refrigerant conduit subsystems 102 through which the refrigerant flows to operate the refrigeration system 100 in the low ambient temperature mode 106 are shown with solid lines, and other refrigerant conduit subsystems 102 that are not in use are shown with dash lines. The refrigeration system 100 may be configured as shown in FIGS. 1A and 1B or in any other suitable configuration. For example, the refrigeration system 100 may include additional components or may omit one or more components shown in FIGS. 1A and 1B. The refrigeration system 100 is controlled by the controller 160.

Figure 2A:
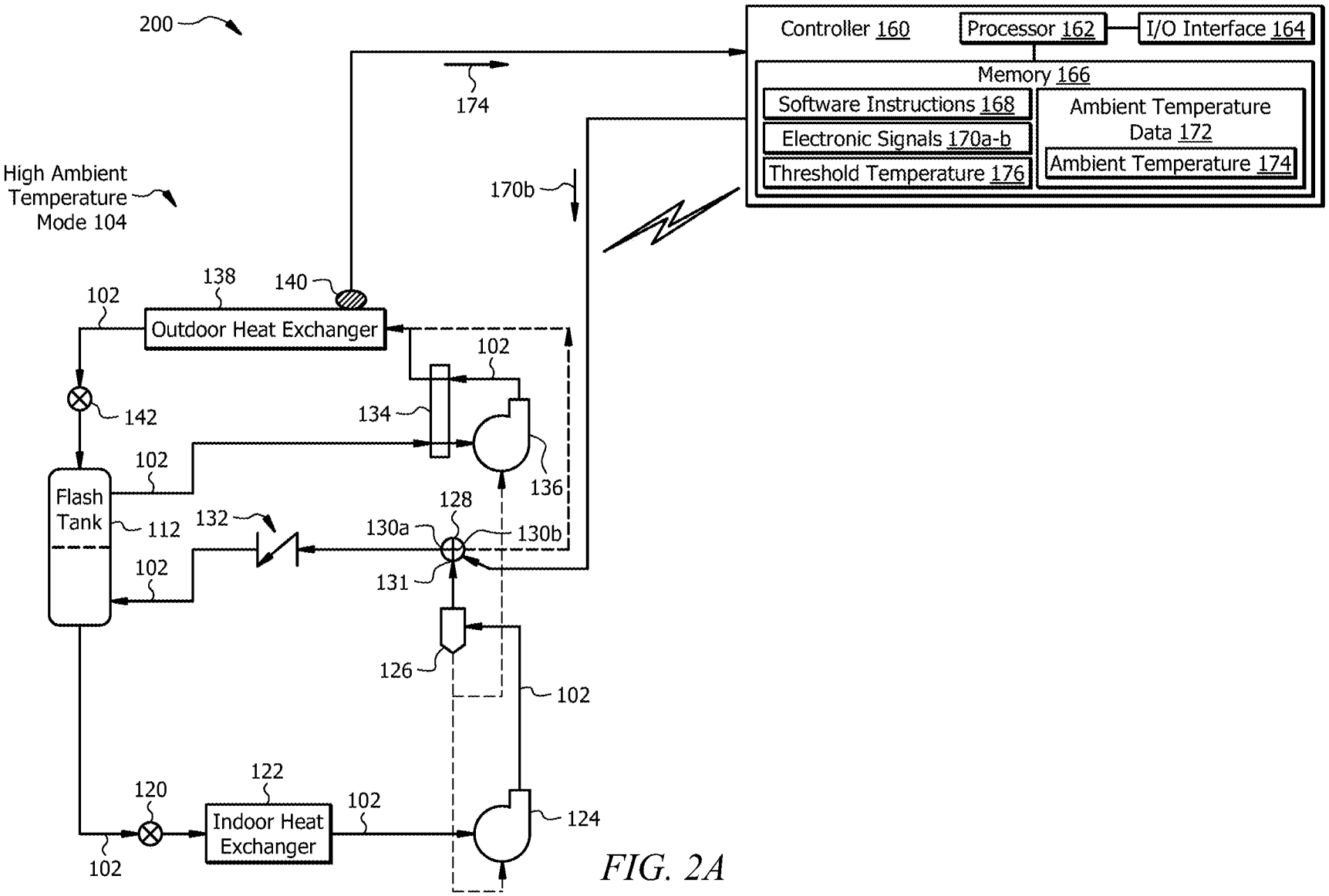
FIGS. 2A and 2B illustrate an embodiment of a refrigeration system configured to control the flow of refrigerant based on ambient temperature and provide a medium temperature conditioning, respectively.
Figure 2B:
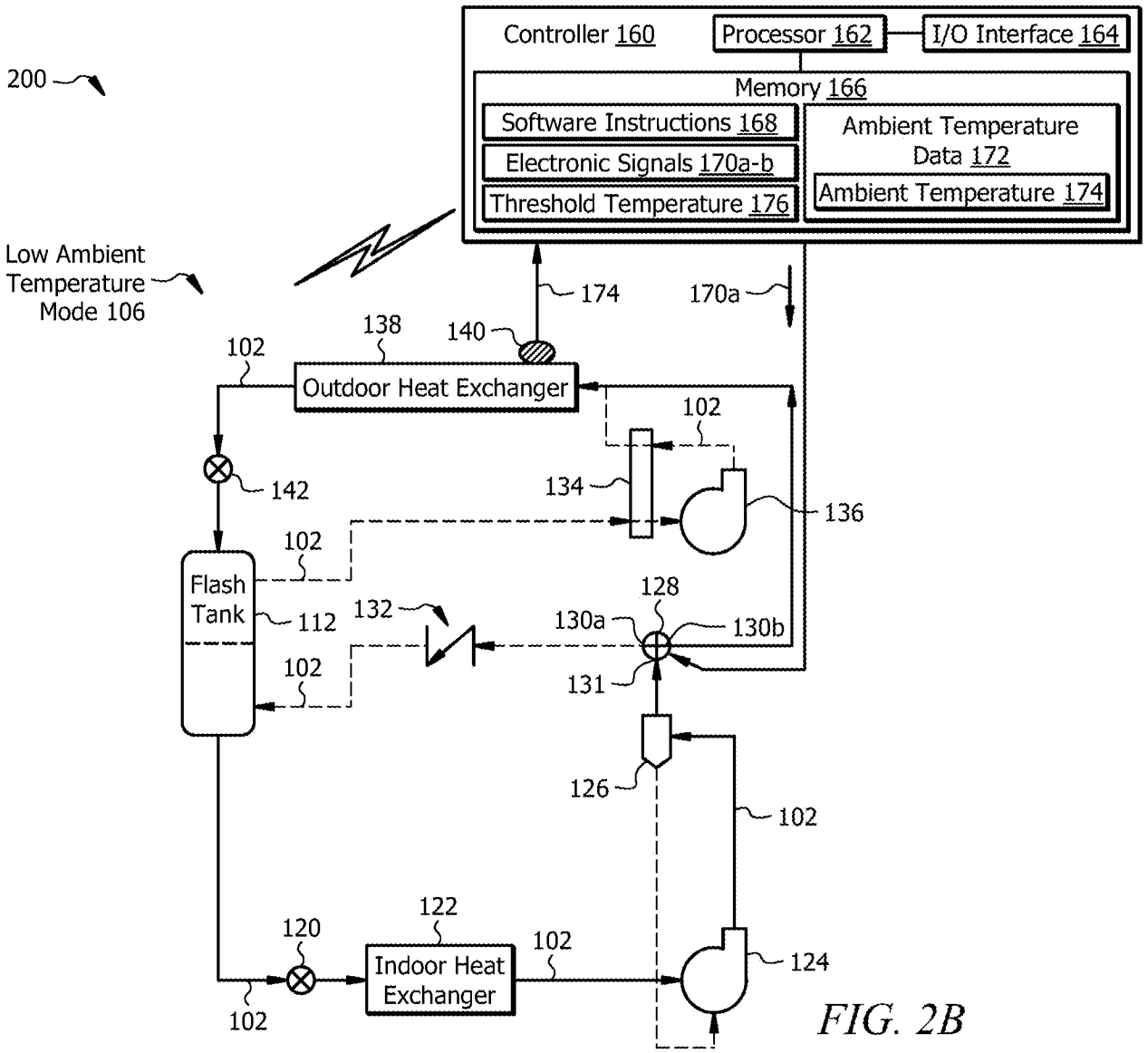
Figure 3A:
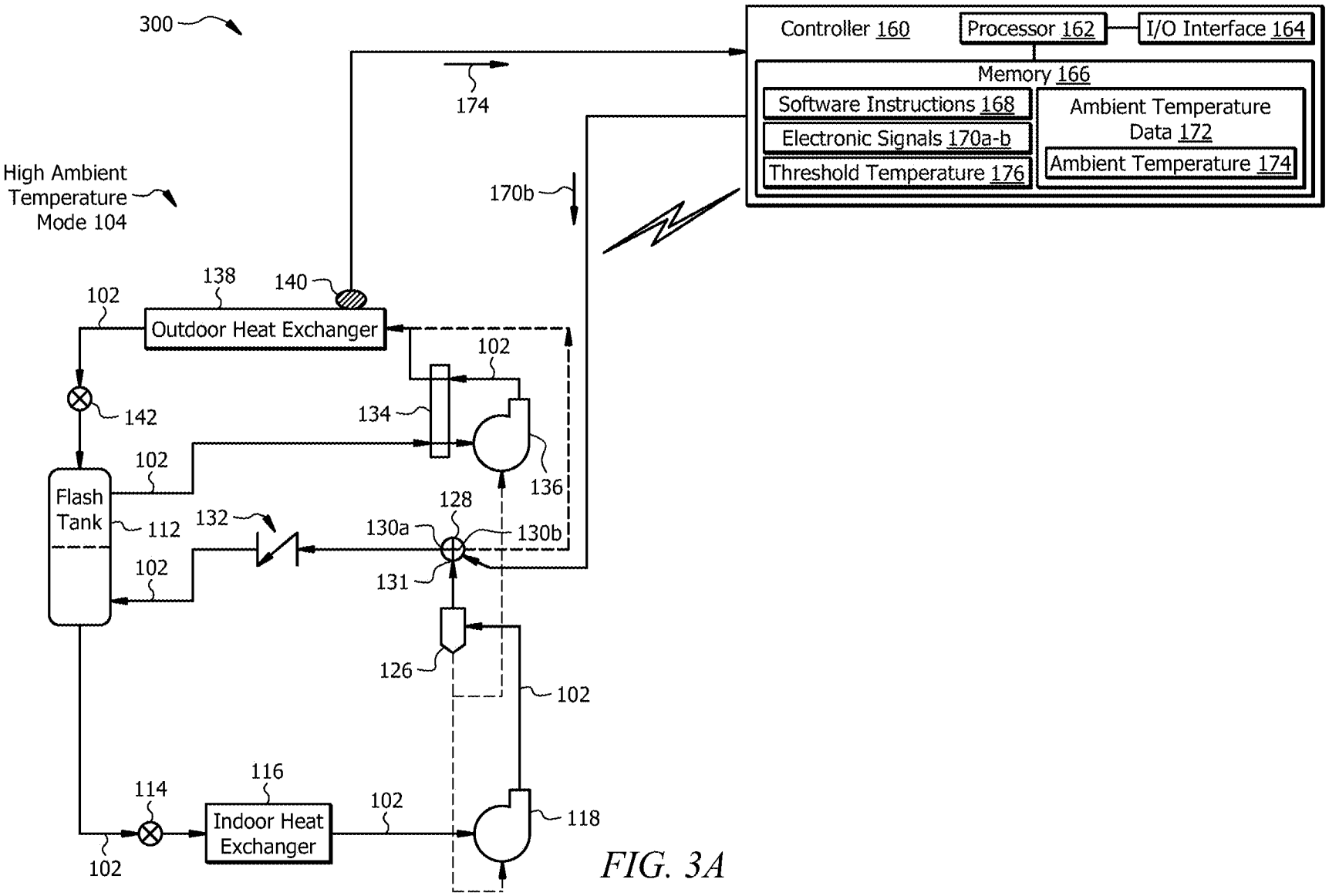
FIGS. 3A and 3B illustrate an embodiment of a refrigeration system configured to control the flow of refrigerant based on ambient temperature and provide a low temperature conditioning, respectively.
Figure 3B:
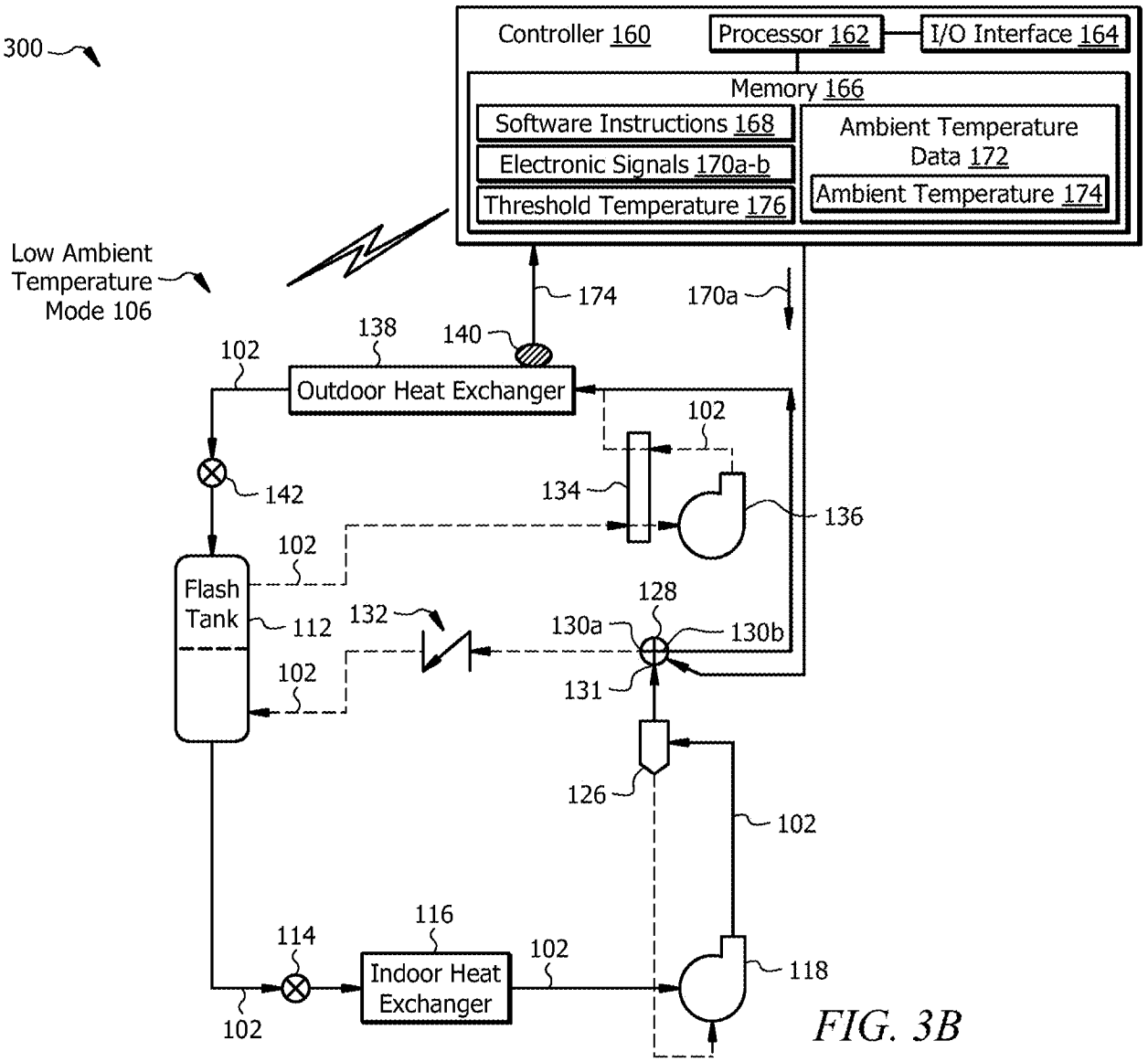
Figure 4:
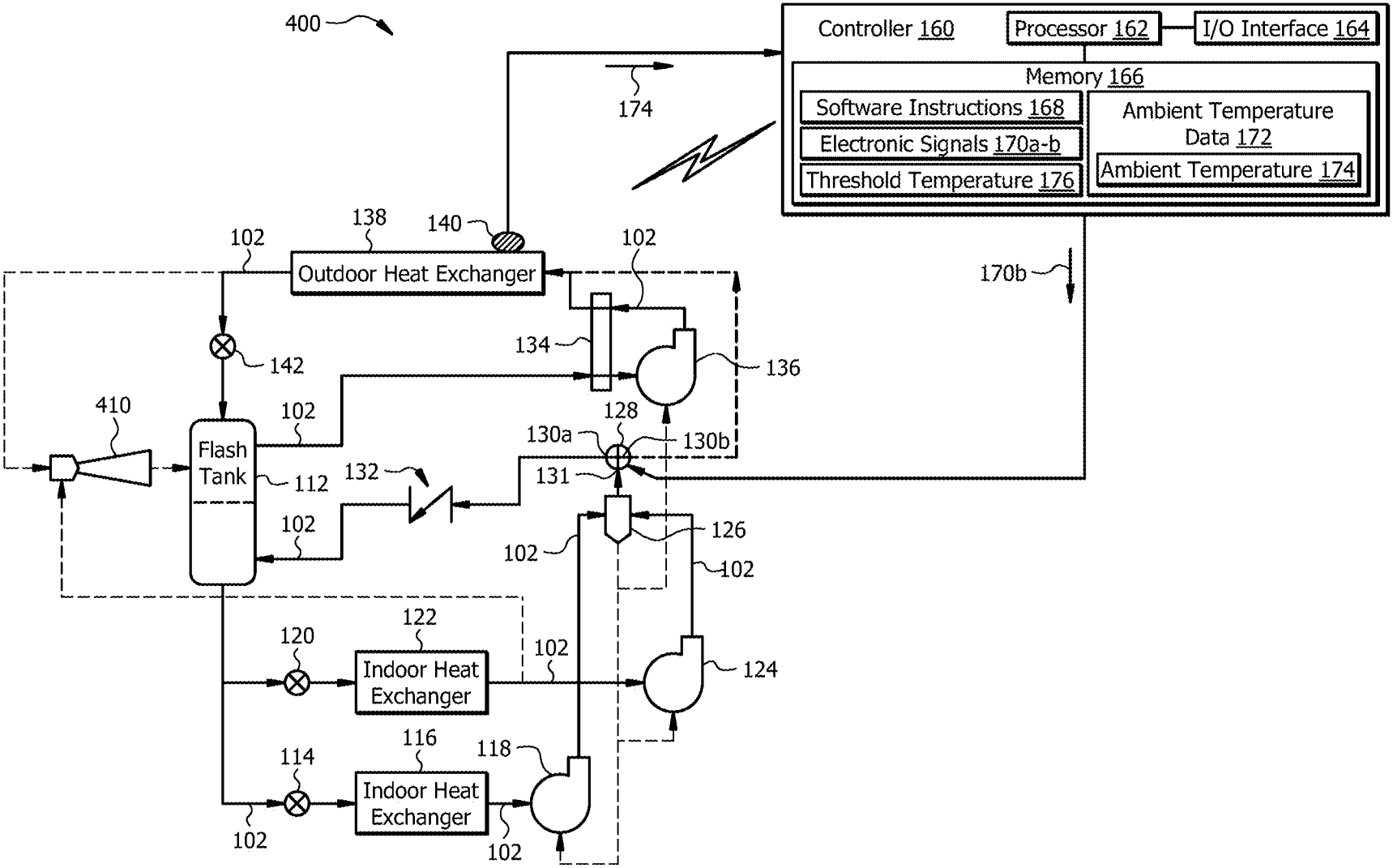
FIG. 4 illustrates an embodiment of a refrigeration system with an additional ejector, configured to control the flow of refrigerant based on ambient temperature and provide a medium temperature conditioning.

FIGS. 1A and 1B illustrate an embodiment of the refrigeration system 100 configured to provide two distinct applications, e.g., low-temperature conditioning, e.g., for freezing applications, and medium-temperature conditioning, e.g., for refrigeration applications. FIGS. 2A and 2B illustrate an embodiment of the refrigeration system 200 configured to provide a medium-temperature conditioning, e.g., for refrigeration applications. FIGS. 3A and 3B illustrate an embodiment of the refrigeration system 300 configured to provide a low-temperature conditioning, e.g., for freezing applications. FIG. 4 illustrates an embodiment of the refrigeration system 400 configured to provide medium-temperature conditioning (e.g., for refrigeration applications), with an additional component ejector.

System Components

Each component labeled with the same reference number in FIGS. 1A to 4 represents the same physical component in the refrigeration system; however, the specific function of each component may vary depending on whether the refrigeration system is operating in high ambient temperature mode 104 (in any of FIGS. 1A, 2A, 3A, and 4) or low ambient temperature mode 106 (in any of FIGS. 1B, 2B, and 3B). The components of the refrigeration system (e.g., any of refrigeration systems 100, 200, 300, and 400) are described below.

The refrigerant conduit subsystems 102 facilitate the movement of a working fluid (e.g., refrigerant) through a refrigeration cycle such that the working fluid flows as illustrated by arrows in each of FIGS. 1A to 4. The refrigerant conduit subsystem 102 includes any conduit, tubing and the like that is illustrated in each of FIGS. 1A to 4 fluidly connecting components of the refrigeration system.

Referring to FIG. 1A, the flash tank 112 may generally be a storage component to store refrigerant in vapor and liquid forms. The flash tank 112 is fluidly coupled to the refrigerant conduit subsystem 102 and is positioned downstream of the outdoor heat exchanger 138 (via the valve 142). The flash tank 112 is configured to separate the refrigerant into a vapor refrigerant and a liquid refrigerant during high ambient temperature mode 104. Typically, the vapor refrigerant collects near the top of the flash tank 112 and the liquid refrigerant is collected at the bottom of the flash tank 112. In some embodiments, when the refrigeration system operates in the high ambient temperature mode 104 (as shows in each of FIGS. 1A, 2A, 3A, and 4), the liquid refrigerant flows from flash tank 112 toward the first indoor heat exchanger 116 and the second indoor heat exchanger 122 in either high ambient temperature mode 104 (see any of FIG. 1A, 2A, 3A, or 4) or low ambient temperature mode 106 (see any of FIG. 1B, 2B, or 3B). Additionally, in the high ambient temperature mode 104, the vapor refrigerant flows from the flash tank 112 toward the suction heat exchanger 134 to facilitate the turning the vapor refrigerant into a superheated vapor before it enters the flash tank vapor compressor 136. In the low ambient temperature mode 106, the valve 142 may be fully open and flash tank 112 may become a receiver that holds liquid refrigerant. the refrigerant flow path from the flash tank 112 to the suction heat exchanger 134 is not in use.

Each of the valves 114 and 120 may generally be a flow control valve, a flash gas valve, a solenoid valve, a motorized valve, a check valve, an electronic expansion valve (EEV), a thermal expansion valve (TXV), and the like. The valve 114 may be positioned in the refrigerant conduit subsystem 102 and located in a portion of the refrigerant conduit subsystem 102 that connects the flash tank 112 to the first indoor heat exchanger 116. The valve 114 is configured to open and close to control the flow of the refrigerant discharged from flash tank 112 toward the first indoor heat exchanger 116. The controller 160 may be in signal communication with the valve 114 (e.g., via wired and/or wireless communication) and control its operation by sending electronic signals to the valve 114, in the examples of EEV valve 114.

The valve 120 may be positioned in the refrigerant conduit subsystem 102 and located in a portion of the refrigerant conduit subsystem 102 that connects the flash tank 112 to the second indoor heat exchanger 122. The valve 120 is configured to open and close to control the flow of the refrigerant discharged from flash tank 112 toward the second indoor heat exchanger 122. The controller 160 may be in signal communication with the valve 120 (e.g., via wired and/or wireless communication) and control its operation by sending electronic signals to the valve 120, in the examples of EEV valve 120.

The first indoor heat exchanger 116 may be a first low-side heat exchanger and generally include one or more indoor evaporator coils and fans to move air across the coils. The first indoor heat exchanger 116 is fluidly coupled to the refrigerant conduit subsystems 102. The first indoor heat exchanger 116 is in signal communication with the controller 160 using wired and/or wireless connection. The controller 160 may send control signals to the first indoor heat exchanger 116 to control the speed of the fans based on temperature conditions. The first indoor heat exchanger 116 may be positioned downstream of the flash tank 112 and configured to absorb heat from the surrounding environment via the refrigerant received from the flash tank 112. The first indoor heat exchanger 116 may act as an evaporator. When the refrigerant reaches the first indoor heat exchanger 116, the refrigerant absorbs heat from the surrounding air in the target indoor space and releases cooled or conditioned air into the target space. For example, the refrigerant cools metallic components (e.g., metallic coils, plates, and/or tubes) of the first indoor heat exchanger 116 as the refrigerant passes through them. These metallic components may then cool the air around them. The cooled air may then be circulated such as, for example, by a fan to cool a space such as, for example, a freezer and/or a refrigerated shelf.

The first compressor 118 may consists of one variable speed compressor and multiple fixed speed compressors and generally configured to compress (e.g., increase the pressure) of the refrigerant received from the first indoor heat exchanger 116. The first compressor 118 is fluidly coupled with the refrigerant conduit subsystem 102. The first compressor 118 is in signal communication with the controller 160 using wired and/or wireless connection. The controller 160 may communicate electronic signals to the first compressor 118 to control the variable speed compressor's speed or turn on and off fixed speed compressors to maintain a constant suction pressure target. The first compressor 118 may be positioned downstream of the first indoor heat exchanger 116 and configured to compress the refrigerant received from the first indoor heat exchanger 116.

The second indoor heat exchanger 122 may be a second low-side heat exchanger and generally include one or more indoor evaporator coils and fans to move air across the coils. The second indoor heat exchanger 122 is fluidly coupled to the refrigerant conduit subsystems 102. The second indoor heat exchanger 122 is in signal communication with the controller 160 using wired and/or wireless connection. The controller 160 may send control signals to the second indoor heat exchanger 122 control the speed of the fans based on temperature conditions. The second indoor heat exchanger 122 may act as an evaporator. When the refrigerant reaches second indoor heat exchanger 122, the refrigerant absorbs heat from the surrounding air in the target indoor space and releases cooled or conditioned air into the target space. For example, the refrigerant cools metallic components (e.g., metallic coils, plates, and/or tubes) of the second indoor heat exchanger 122 as the refrigerant passes through them. These metallic components may then cool the air around them. The cooled air may then be circulated such as, for example, by a fan to cool a space such as, for example, a freezer and/or a refrigerated shelf. The first indoor heat exchanger 116 may be configured to maintain the temperature of the refrigerant at a first temperature (such as −20, −22, −24 degrees Fahrenheit, −29, −30, −31 degrees Celsius) based on cooling demand for freezing applications. The second indoor heat exchanger 122 may be configured to maintain the temperature of the refrigerant at a second temperature (such as 25, 27, 29 degrees Fahrenheit, −4, −3, −2 degrees Celsius) based on cooling demand for refrigeration applications, where the first temperature may be lower than the second temperature.

The second compressor 124 may consists of one variable speed compressor and multiple fixed speed compressors and generally configured to compress (e.g., increase the pressure) of the refrigerant. The second compressor 124 is fluidly coupled with the refrigerant conduit subsystem 102. The second compressor 124 is in signal communication with the controller 160 using wired and/or wireless connection. The controller 160 may communicate electronic signals to the second compressor 124 to control the variable speed compressor's speed or turn on and off fixed speed compressors to maintain a constant suction pressure target. The second compressor 124 may be positioned downstream of the second indoor heat exchanger 122 and configured to compress the refrigerant received from the second indoor heat exchanger 122.

The oil separator 126 separates an oil from the refrigerant discharged from each of the first compressor 118 and the second compressor 124 and returns the oil back to the compressors. In some examples, the oil separator 126 may be a coalescing oil separator, centrifugal oil separator, or any other type. For example, the coalescing oil separator may include mesh-shaped filters to separate oil from the refrigerant to merge into larger oil droplets, which cannot pass through the mesh. In another example, the centrifugal oil separator separates the oil from the refrigerant by spinning the oil-refrigerant mixture to use the centrifuge force to cause the oil to move outward and be separated from the refrigerant. The oil separator 126 is positioned downstream of the first compressor 118 and the second compressor 124. The oil separator 126 separates an oil from the refrigerant before it enters the outdoor heat exchanger 138 or other downstream components. The oil may be introduced to certain components of system 100, such as first compressor 118 and/or the second compressor 124 for lubrication of the interior of the compressors. In some occasions, the oil may be mixed with the refrigerant as it passes through the compressors. By separating out the oil, the efficiency of outdoor heat exchanger 138 is maintained. If oil separator 126 were not present, then the oil may clog any of the heat exchangers, such as the indoor heat exchangers 116 and 122, the outdoor heat exchanger 138, and/or the suction heat exchanger 134, which may reduce the refrigerant's ability to absorb or release heat in the heat exchangers, which leads to the heat transfer efficiency of system 100 being reduced.

The switching valve 128 may be a motorized valve, a solenoid valve, an EEV, or any other suitable valve configured to selectively switch the flow of refrigerant between two paths (e.g., from the first compressor 118 towards either the flash tank 112 or the outdoor heat exchanger 138 depending on the detected ambient temperature 174 (indicated in the ambient temperature data 172). In other words, the switching valve 128 may selectively switch the flow of the refrigerant between the flash tank 112 and the outdoor heat exchanger 138 depending on the detected ambient temperature 174. The switching valve 128 may be in signal communication with the controller 160 using wired and/or wireless connection. The controller 160 may send electronic signals 170*a-b* to the switching valve 128 to change the direction of the refrigerant flow depending on the ambient temperature 174, as described herein. The switching valve 128 is positioned downstream of the oil separator 126. The switching valve 128 is fluidly coupled to the refrigerant conduit subsystem 102. The switching valve 128 may include one inlet 131 and two outlets 130*a* and 130*b*, where the first outlet 130*a* is toward the check valve 132 and the flash tank 112, and the second outlet 130*b* is toward the outdoor heat exchanger 138. The outlet 130*a* connects the refrigerant conduit subsystem 102 from the switching valve 128 to the refrigerant conduit subsystem 102 that is connected to the check valve 132 and the flash tank 112. The second outlet 130*b* connects the refrigerant conduit subsystem 102 from the switching valve 128 to the refrigerant conduit subsystem 102 that is connected to the outdoor heat exchanger 138.

The check valve 132 may be used to maintain a pressure differential between oil separator 126 and flash tank 112 so oil inside the oil separator 126 can be fed into FTV compressor 136. The check valve 132 is fluidly coupled to the refrigerant conduit subsystems 102. The check valve 132 may be positioned downstream of the switching valve 128 and is generally configured to direct the refrigerant received from the switching valve 128 toward the flash tank 112 during the high ambient temperature mode 104 (see the left side of FIG. 1). The check valve 132 may be a unidirectional valve and prevent the refrigerant to flowback to the switching valve 128. The check valve 132 may maintain the preconfigured refrigerant pressure differential before and after it so the refrigerant's pressure after the check valve 132 is lower than the pressure before the check valve 132.

The suction heat exchanger 134 may be a plate heat exchanger, a shell and tube heat exchanger, a coaxial heat exchanger, or a finned-tube heat exchanger, among others. The suction heat exchanger 134 may be fluidly coupled to the refrigerant conduit subsystems 102 and positioned downstream of the flash tank 112. The suction heat exchanger 134 may be configured to receive vapor refrigerant from the flash tank 112 and facilitate the turning the vapor refrigerant into a superheated vapor before it enters the flash tank vapor compressor 136 during the high ambient temperature mode 104 (see FIG. 1A). In some cases, the vapor refrigerant received from the flash tank 112 may be mixed with residual liquid refrigerant mist or droplets. The suction heat exchanger 134 is fluidly coupled with the input and output of the FTV compressor 136. The output of the FTV compressor 136 may be a hot gaseous refrigerant. The suction heat exchanger 134 may use the hot gaseous refrigerant to evaporate the residual liquid refrigerant mist or droplet mixed with the vapor refrigerant received from the flash tank 112 by transferring heat from the hot gaseous refrigerant received from the FTV compressor 136 to the vapor refrigerant mixed with the liquid refrigerant mist or droplets received from the flash tank 112. Thus, the suction heat exchanger 134 removes the liquid refrigerant from entering the FTV compressor 136. The suction heat exchanger 134 is in signal communication with the controller 160 via wired and/or wireless connection. The controller 160 may send electronic signals to the suction heat exchanger 134 to control some or all of its functions.

The FTV compressor 136 may be a rotary compressor, a scroll compressor, or any other type of compressor and is generally configured to compress the refrigerant, e.g., increase its temperature and pressure before it flows toward the outdoor heat exchanger 138 during the high ambient temperature mode 104 (see the left side of FIG. 1). The FTV compressor 136 may be positioned downstream of the suction heat exchanger 134 and the flash tank 112. The FTV compressor 136 is fluidly coupled with the refrigerant conduit subsystem 102. The FTV compressor 136 may be in signal communication with the controller 160 via wired and/or wireless connection. The controller 160 may send electronic signals to the FTV compressor 136 to control some or all of its functions, such as its speed and/or on/off operations. The FTV compressor 136 may be operated to maintain a constant or substantially constant flash tank pressure target The outdoor heat exchanger 138 may be a high-side heat exchanger, such as a gas cooler or a condenser, and generally includes one or more coils and fans to move the air across the coils. The outdoor heat exchanger 138 is fluidly coupled with the refrigerant conduit subsystem 102. The outdoor heat exchanger 138 is in signal communication with the controller 160 using wired and/or wireless connection. The controller 160 may send electronic signals to the outdoor heat exchanger 138 to control the speed of the fans based on temperature conditions. The outdoor heat exchanger 138 is configured to transfer heat from the refrigerant into the surrounding outdoor environment. The outdoor heat exchanger 138 removes heat from the refrigerant. When heat is removed from the refrigerant, the refrigerant is cooled. The outdoor heat exchanger 138 may be operated as a condenser and/or a gas cooler. When operating as a condenser, outdoor heat exchanger 138 cools the refrigerant such that the state of the refrigerant changes from a gas to a liquid. When operating as a gas cooler, outdoor heat exchanger 138 cools gaseous refrigerant and the refrigerant remains a gas. In certain configurations, the outdoor heat exchanger 138 is positioned such that heat removed from the refrigerant may be discharged into the air. For example, the outdoor heat exchanger 138 may be positioned on a rooftop so that heat removed from the refrigerant may be discharged into the air. As another example, the outdoor heat exchanger 138 may be positioned external to a building and/or on the side of a building. This disclosure contemplates any suitable refrigerant (e.g., carbon dioxide) being used in any of the disclosed cooling systems. The refrigeration system 100 may include any appropriate number of outdoor heat exchangers 138 with the same or a similar configuration to that shown for the example of the outdoor heat exchanger 138 in FIGS. 1A to 4.

The temperature sensor circuit 140 may include a temperature sensing element and circuitry. The temperature sensor circuit 140 may be implemented by a hardware circuit and configured to detect the ambient temperature 174 within a vicinity of the refrigeration system 100, e.g., the temperature 174 of the air surrounding the outdoor heat exchanger 138 within a detection range, such as within ten inches, five feet, or any other detection range. The temperature sensor circuit 140 may include a temperature sensing element such as a thermocouple, a thermistor, a semiconductor-based temperature circuit board, or any other type of temperature sensor. The temperature sensor circuit 140 is in signal communication with the controller 160 using wired and/or wireless connection. The temperature sensor circuit 140 may be positioned adjacent to the outdoor heat exchanger 138. The temperature sensor circuit 140 may be attached on a surface and/or the outdoor heat exchanger 138 using any appropriate means (e.g., threaded connections, clamps, adhesives, or the like). The temperature sensor circuit 140 is configured to detect the ambient temperature 174 periodically (e.g., every second, every minute, etc.) and/or on demand (e.g., in response to a request from a user provided to the controller 160 or a control panel). The temperature sensor circuit 140 may provide the detected temperature 174 to the controller 160. The controller 160 may store the data points indicating a set of detected ambient temperature 174 in the ambient temperature data 172.

The valve 142 may be a high-pressure valve, a motorized valve, a solenoid valve, an EEV, a TXV, or any other suitable valve configured to control the flow of the refrigerant. The valve 142 is fluidly coupled with the refrigerant conduit subsystem 102. The valve 142 is in signal communication with the controller 160 using wired and/or wireless connection. The valve 142 is positioned downstream of the outdoor heat exchanger 138 and configured to receive the refrigerant discharged from the outdoor heat exchanger 138. The valve 142 is configured to reduce the pressure of the refrigerant received from the outdoor heat exchanger 138 before it reaches the flash tank 112. The valve 142 may regulate the pressure of the refrigerant.

In the high ambient temperature mode 104, the valve 142 may be configured to maintain a high pressure (e.g., 80-100 bars, 1160-1450 pounds per square inch (PSI), or 8-10 megapascal (MPa)) for the refrigerant before it flows to the flash tank 112. In the low ambient temperature mode 106, the valve 142 may be configured to be fully opened to allow unrestricted flow of the refrigerant. In some embodiments, the valve 142 may be automatically adjusted based on an operating pressure differential configured in the refrigeration system (e.g., any of refrigeration system 100 of FIGS. 1A and 1B, refrigeration system 200 of FIGS. 2A and 2B, refrigeration system 300 of FIGS. 3A and 3B, and refrigeration system 400 of FIG. 4)), e.g., in case of TXV or high-pressure valve 142. In some embodiments, the controller 160 may send electronic signals to the valve 142 to control the flow of the refrigerant based on the configured operating pressure differential, e.g., in case of EEV valve 142.

The controller 160 is communicatively coupled to other components in the refrigeration system (e.g., any of refrigeration system 100 of FIGS. 1A and 1B, refrigeration system 200 of FIGS. 2A and 2B, refrigeration system 300 of FIGS. 3A and 3B, and refrigeration system 400 of FIG. 4) via wired and/or wireless connection. The controller 160 is configured to control the operations of the other components of the refrigeration system (e.g., any of refrigeration systems 100 of FIGS. 1A and 1B, refrigeration system 200 of FIGS. 2A and 2B, refrigeration system 300 of FIGS. 3A and 3B, and refrigeration system 400 of FIG. 4) by sending electronic signals to each of them. In some embodiments, controller 160 can be one or more controllers associated with one or more components of the refrigeration system (e.g., any of the refrigeration system 100 of FIGS. 1A and 1B, refrigeration system 200 of FIGS. 2A and 2B, refrigeration system 300 of FIGS. 3A and 3B, and refrigeration system 400 of FIG. 4). The controller 160 includes a processor 162 communicatively coupled to, and in signal communication with, a memory 166 and an input/output (I/O) interface 164. The processor 162 comprises one or more processors. The processor 162 is any electronic circuitry including, but not limited to, state machines, one or more central processing unit (CPU) chips, logic units, cores (e.g., a multi-core processor), field-programmable gate array (FPGAs), application-specific integrated circuits (ASICs), or digital signal processors (DSPs) that communicatively couples to memory 166 and controls the operation of refrigeration system 100. The processor 162 may be a programmable logic device, a microcontroller, a microprocessor, or any suitable combination of the preceding. The one or more processors are configured to process data and may be implemented in hardware or software. For example, the processor 162 may be 8-bit, 16-bit, 32-bit, 64-bit or of any other suitable architecture. The processor 162 may include an arithmetic logic unit (ALU) for performing arithmetic and logic operations, processor registers that supply operands to the ALU and store the results of ALU operations, and a control unit that fetches instructions from memory 166 and executes them by directing the coordinated operations of the ALU, registers, and other components. The processor 162 may include other hardware and software that operates to process information, control the refrigeration system (e.g., any of the refrigeration system 100 of FIGS. 1A and 1B, refrigeration system 200 of FIGS. 2A and 2B, refrigeration system 300 of FIGS. 3A and 3B, and refrigeration system 400 of FIG. 4), and perform any of the functions described herein. The processor 162 may be configured to execute software instructions to perform operations of the controller 160. For example, the processor 162 may be configured to execute the software instructions 168 to cause the refrigeration system (e.g., any of the refrigeration system 100 of FIGS. 1A and 1B, refrigeration system 200 of FIGS. 2A and 2B, refrigeration system 300 of FIGS. 3A and 3B, and refrigeration system 400 of FIG. 4) to enter the high ambient temperature mode 104 or the low ambient temperature mode 106 depending on the detected ambient temperature 174. The processor 162 may execute code/software instructions 168 to perform any of its operations. The processor 162 is not limited to a single processing device and may encompass multiple processing devices. The processor 162 may be configured to perform one or more operations of the controller 160 described in FIGS. 1A to 4, and one or more operations of the method 500 described in FIG. 5.

The memory 166 may be a non-transitory computer-readable medium. The memory 166 includes one or more disks, tape drives, or solid-state drives, and may be used as an overflow data storage device to store programs when such programs are selected for execution, and to store instructions and data that are read during program execution. The memory 166 may be volatile or non-volatile and may comprise read-only memory (ROM), random-access memory (RAM), ternary content-addressable memory (TCAM), dynamic random-access memory (DRAM), and static random-access memory (SRAM). The memory 166 is operable to store any suitable set of instructions, logic, rules, and/or code for executing the functions described in this disclosure. For example, the memory 166 may store software instructions 168, electronic signals 170*a-b*, ambient temperature data 172, threshold temperature 176, and/or other data, instructions, and operating parameters for components in the system 100.

The I/O interface 164 is configured to communicate data and signals with other devices. For example, the I/O interface 164 may be configured to communicate electrical signals with the other components of the refrigeration systems 100. The I/O interface 164 may comprise ports and/or terminals for establishing signal communications between the controller 160 and other devices. The I/O interface 164 may be configured to enable wired and/or wireless communications. Connections between various components off the refrigeration system (e.g., any of the refrigeration system 100 of FIGS. 1A and 1B, refrigeration system 200 of FIGS. 2A and 2B, refrigeration system 300 of FIGS. 3A and 3B, and refrigeration system 400 of FIG. 4) and between components of the refrigeration system may be wired or wireless. For example, conventional cable and contacts may be used to couple the controller 160 and various components of the refrigeration system (e.g., refrigeration system 100 of FIGS. 1A and 1B, refrigeration system 200 of FIGS. 2A and 2B, refrigeration system 300 of FIGS. 3A and 3B, and refrigeration system 400 of FIG. 4). In some embodiments, a wireless connection may be employed to provide at least some or all of the connections between components of the refrigeration system (e.g, refrigeration system 100 of FIGS. 1A and 1B, refrigeration system 200 of FIGS. 2A and 2B, refrigeration system 300 of FIGS. 3A and 3B, and refrigeration system 400 of FIG. 4). In some embodiments, a data bus may couple various components of the refrigeration system (e.g., refrigeration system 100 of FIGS. 1A and 1B, refrigeration system 200 of FIGS. 2A and 2B, refrigeration system 300 of FIGS. 3A and 3B, and refrigeration system 400 of FIG. 4) together such that data is communicated therebetween. In some embodiments, the data bus may include, for example, any combination of hardware, software embedded in a computer-readable medium, or encoded logic incorporated in hardware or otherwise stored (e.g., firmware) to couple components of the refrigeration system (e.g., refrigeration system 100 of FIGS. 1A and 1B, refrigeration system 200 of FIGS. 2A and 2B, refrigeration system 300 of FIGS. 3A and 3B, and refrigeration system 400 of FIG. 4) to each other.

As an example and not by way of limitation, the data bus may include an accelerated graphics port (AGP) or other graphics bus, a controller area network (CAN) bus, a front-side bus (FSB), a hypertransport (HT) interconnect, an interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a video electronics standards association local bus (VLB), or any other suitable bus or a combination of two or more of these. In various embodiments, the data bus may include any number, type, or configuration of data buses, where appropriate. In certain embodiments, one or more data buses (which may each include an address bus and a data bus) may couple the controller 160 to other components of the refrigeration system (e.g., refrigeration system 100 of FIGS. 1A and 1B, refrigeration system 200 of FIGS. 2A and 2B, refrigeration system 300 of FIGS. 3A and 3B, and refrigeration system 400 of FIG. 4).

Operational Flow for Operating in High or Low Ambient Temperature Mode

In operation, the controller 160 may operate the refrigeration system 100 in either high ambient temperature mode 104 (as shown in FIG. 1A) or low ambient temperature mode 106 (as shown in FIG. 1B) depending on the detected ambient temperature 174. To this end, the controller 160 may monitor the ambient temperature 174 detected and received from the temperature sensor circuit 140.

In operation, the controller 160 may receive the ambient temperature 174 from the temperature sensor circuit 140 and determine whether the detected ambient temperature 174 is less than a threshold temperature 176. In some examples, the threshold temperature 176 may be 50, 51, 52, 53 degrees Fahrenheit (10-12 degrees Celsius) or any other temperature. In response to determining that the detected ambient temperature 174 is less than the threshold temperature 176, the controller 160 may initiate operating the refrigeration system 100 in the low ambient temperature mode 106, and in response, the refrigerant flows through the system 100 as described with respect to FIG. 1B. Otherwise, the controller 160 may initiate operating the refrigeration system 100 in the high ambient temperature mode 104, and in response, the refrigerant flows through the system 100 as described with respect to FIG. 1A.

Operating in High Ambient Temperature Mode

Referring to FIG. 1A, in response to determining that the detected ambient temperature 174 is more than or equal to the threshold temperature 176, the controller 160 may initiate operating the refrigeration system 100 in the high ambient temperature mode 104, as shown in FIG. 1A. To this end, the controller 160 may communicate second electronic signal 170*b* to the switching valve 128 to direct the flow path of the refrigerant from the switching valve 128 toward the flash tank 112 (via the check valve 132). The second electronic signal 170*b* may cause the first outlet 130*a* of the switching valve 128 to at least partially open and the second outlet 130*b* of the switching valve 128 to at least partially close. This results in the refrigerant flow from the inlet 131 of the switching valve 128 to the flash tank 112 (and the check valve 132) and restrict or prevent the refrigerant flow from the inlet 131 to the outdoor heat exchanger 138. The controller 160 operates the refrigeration system 100 in the high ambient temperature mode 104 until the ambient temperature 174 reduces to be less than the threshold temperature 176.

In high ambient temperature mode 104, when the switching valve 128 redirects the refrigerant toward the flash tank 112 (via the check valve 132), the refrigerant enters the flash tank 112, where it is separated into vapor and liquid. The liquid refrigerant collects at the bottom of the flash tank 112 and is then directed toward the first indoor heat exchanger 116 and the second indoor heat exchanger 122 to maintain the cooling demands (e.g., for freezing and refrigeration applications) to the respective target spaces as required. The vapor refrigerant, accumulated at the top of the flash tank 112, is directed to the suction heat exchanger 134. The vapor refrigerant is superheated in the suction heat exchanger 134 and gaseous refrigerant is provided to the FTV compressor 136. The FTV compressor 136 compresses the refrigerant to a higher pressure and the high-pressured vapor refrigerant is directed toward the outdoor heat exchanger 138.

The outdoor heat exchanger 138 releases heat from the refrigerant into the outdoor environment. The cooled refrigerant from outdoor heat exchanger 138 flows to the valve 142 to reduce the pressure of the refrigerant received from the outdoor heat exchanger 138 before it reaches the flash tank 112. In the flash tank 112, the refrigerant is separated again into vapor and liquid phases. The vapor refrigerant from the flash tank 112 may flow toward the suction heat exchanger 134 to continue the cooling the refrigerant via the FTV compressor 136 and the outdoor heat exchanger 138. The liquid refrigerant from the flash tank 112 may flow toward the valves 114 and 120 to distribute the refrigerant to the first indoor heat exchanger 116 and the second indoor heat exchanger 122, respectively, to provide cooling demands (e.g., for freezing and refrigeration applications) to the respective target spaces as required. This cycle may continue while the ambient temperature 174 is higher than or equal to the threshold temperature 176.

The controller 160 may selectively switch between the low ambient temperature mode 106 and the high ambient temperature mode 104 (see any of FIGS. 1A, 2A, 3A, and 4) depending on the detected ambient temperature 174. The low ambient temperature mode 106 (see any of FIGS. 1B, 2B, and 3B) may correspond to when the detected ambient temperature 174 is less than the threshold temperature 176. The high ambient temperature mode 104 may correspond to when the detected ambient temperature 174 is more than or equal to the threshold temperature 176.

Operating in Low Ambient Temperature Mode

Referring to FIG. 1B, when operating in the low ambient temperature mode 106, the controller 160 may communicate a first electronic signal 170*a* to the switching valve 128 to direct the flow of the refrigerant from the switching valve 128 toward the outdoor heat exchanger 138. In this way the switching valve 128 (and the refrigerant flowing from the switching valve 128) may bypass the FTV compressor 136. The first electronic signal 170*a* may cause the first outlet 130*a* of the switching valve 128 to at least partially close and the second outlet 130*b* of the switching valve 128 to at least partially open. This results in the refrigerant flow from the inlet 131 of the switching valve 128 to the outdoor heat exchanger 138 and restrict or prevent the refrigerant flow from the inlet 131 of the switching valve 128 to the flash tank 112. The controller 160 operates the refrigeration system 100 in the low ambient temperature mode 106 until the ambient temperature 174 increases to be more than or equal to the threshold temperature 176.

In the low ambient temperature mode 106, when the switching valve 128 redirects the refrigerant toward the outdoor heat exchanger 138, the outdoor heat exchanger 138 may receive the refrigerant from the switching valve 128 and transfer heat from the refrigerant to the surrounding outdoor air. This cools the refrigerant before it goes to a next cycle in the system 100. The cooled refrigerant flows through the valve 142 and then to the flash tank 112, operating as a receiver. The liquid refrigerant flows from the flash tank 112 to the valves 114 and 120 in parallel.

The valve 114 may control the flow of the refrigerant flowing into the first indoor heat exchanger 116. The first indoor heat exchanger 116 may provide conditioned air to the first target indoor space when the refrigerant flows through the coils of the first indoor heat exchanger 116. As the refrigerant flows through the coils, it absorbs heat from the indoor space, which cools the air in the first indoor target space. This raises the temperature of the refrigerant. The refrigerant flows from the first indoor heat exchanger 116 toward the first compressor 118 and the first compressor 118 compresses the refrigerant to increase its pressure and/or temperature. The refrigerant then flows to the oil separator 126.

The valve 120 may control the flow of the refrigerant flowing into the second indoor heat exchanger 122. The second indoor heat exchanger 122 may provide conditioned air to the second target indoor space when the refrigerant flows through the coils of the first indoor heat exchanger 116. As the refrigerant flows through the coils, it absorbs heat from the indoor space, which cools the air in the second indoor target space. This raises the temperature of the refrigerant. The refrigerant flows from the second indoor heat exchanger 122 toward the second compressor 124 and the second compressor 124 compresses the refrigerant to increase its pressure and/or temperature. The refrigerant then flows to the oil separator 126.

The oil separator 126 may separate the oil from the refrigerant received from the first compressor 118 and the second compressor 124, return the separated oil back to the compressors, and provide the refrigerant to the switching valve 128. The switching valve 128 may direct the refrigerant toward the outdoor heat exchanger 138. This cycle may continue while the ambient temperature 174 is less than the threshold temperature 176.

Example Refrigeration System Configuration for Providing Cooling for Medium Temperature Applications FIGS. 2A and 2B illustrate an embodiment of the refrigeration system 200 configured to provide a medium temperature conditioning, e.g., for refrigeration applications, when operating in the high ambient temperature mode 104 (in FIG. 2A) and in the low ambient temperature mode 106 (in FIG. 2B). The example embodiments illustrated in FIGS. 2A and 2B are substantially similar to the example embodiments illustrated in FIGS. 1A and 2B, respectively, except that, in FIGS. 2A and 2B, the refrigeration system 200 does not include the valve 114, indoor heat exchanger 116, and compressor 118. The rest of the components illustrated in each of FIGS. 2A and 2B are the same or substantially the same components as of those illustrated and described in conjunction with the description of FIGS. 1A and 1B, respectively. Therefore, for brevity, the description of the same components that are described in conjunction of FIGS. 1A and 1B are not repeated here.

FIG. 2A illustrates the flow of the refrigerant through the refrigeration system 200 operating in a high ambient temperature mode 104. In the high ambient temperature mode 104, the refrigerant conduit subsystems 102 through which the refrigerant flows to operate the refrigeration system 200 in the high ambient temperature mode 104 are shown with solid lines, and other refrigerant conduit subsystems 102 that are not in use are shown with dash lines.

FIG. 2B illustrates the flow of the refrigerant through the refrigeration system 200 operating in a low ambient temperature mode 106. In the low ambient temperature mode 106, the refrigerant conduit subsystems 102 through which the refrigerant flows to operate the refrigeration system 200 in the low ambient temperature mode 106 are shown with solid lines, and other refrigerant conduit subsystems 102 that are not in use are shown with dash lines. The refrigeration system 200 may be configured as shown in each of FIGS. 2A and 2B or in any other suitable configuration. For example, the refrigeration system 200 may include additional components or may omit one or more components shown in each of FIGS. 2A and 2B. The refrigeration system 200 is controlled by the controller 160.

In operation, the controller 160 receives the ambient temperature 174 from the temperature sensor circuit 140 and determines whether the ambient temperature 174 is less than the threshold temperature 176. In response to determining that the ambient temperature 174 is more than or equal to the threshold temperature 176, the controller 160 initiates the high ambient temperature mode 104 and, in response, the refrigerant flows through the system 200 as described with respect to FIG. 2A. Otherwise, the controller 160 initiates the low ambient temperature mode 106, and in response, the refrigerant flows through the system 200 as described with respect to FIG. 2B.

Operating in High Ambient Temperature Mode

Referring to FIG. 2A, when the controller 160 operates the refrigeration system 200 in the high ambient temperature mode 104, the refrigerant begins its flow through the system similar to the flow described with respect to high ambient temperature mode 104 as described in FIG. 1A, except flowing through the valve 114, indoor heat exchanger 116, and compressor 118. In the high ambient temperature mode 104, the general operational flow remains similar to the operational flow of high ambient temperature mode 104 described in conjunction with FIG. 1A.

In operation, the controller 160 may communicate the second electronic signal 170*b* to the switching valve 128 to direct the flow path of the refrigerant from the switching valve 128 toward the flash tank 112 (via the check valve 132). The second electronic signal 170*b* may cause the first outlet 130*a* of the switching valve 128 to at least partially open and the second outlet 130*b* of the switching valve 128 to at least partially close. This results in the refrigerant flow from the inlet 131 of the switching valve 128 to the flash tank 112 (and the check valve 132) and restrict or prevent the refrigerant flow from the inlet 131 to the outdoor heat exchanger 138.

The refrigerant is separated into vapor and liquid forms within the flash tank 112. The vapor refrigerant is superheated in the suction heat exchanger 134 and gaseous refrigerant is provided to the FTV compressor 136. The FTV compressor 136 compresses the refrigerant to a higher pressure and the high-pressured vapor refrigerant is directed toward the outdoor heat exchanger 138. The outdoor heat exchanger 138 releases heat from the refrigerant into the outdoor environment. The cooled refrigerant from outdoor heat exchanger 138 flows to the valve 142 to reduce the pressure of the refrigerant received from the outdoor heat exchanger 138 before it reaches the flash tank 112. In the flash tank 112, the refrigerant is separated again into vapor and liquid.

The liquid refrigerant from the flash tank 112 may flow toward the valve 120 to direct the refrigerant to the second indoor heat exchanger 122 to provide cooling demand (e.g., refrigeration applications) to the target space as required. This cycle may continue while the ambient temperature 174 is higher than or equal to the threshold temperature 176. The controller 160 operates the refrigeration system 200 in the high ambient temperature mode 104 until the ambient temperature 174 reduces to be less than the threshold temperature 176.

Operating in Low Ambient Temperature Mode

Referring to FIG. 2B, when the controller 160 operates the refrigeration system 200 in the low ambient temperature mode 106, the refrigerant begins its flow through the system similar to the flow described with respect to the low ambient temperature mode 106 described in FIG. 1B, except flowing through the valve 114, indoor heat exchanger 116, and compressor 118. In the low ambient temperature mode 106, the general operational flow remains similar to the operational flow of the low ambient temperature mode 106 described in conjunction with FIG. 1B.

In operation, the controller 160 may communicate a first electronic signal 170*a* to the switching valve 128 to direct the flow of the refrigerant from the switching valve 128 toward the outdoor heat exchanger 138. In this way the switching valve 128 (and the refrigerant flowing from the switching valve 128) may bypass the FTV compressor 136. The first electronic signal 170*a* may cause the first outlet 130*a* of the switching valve 128 to at least partially close and the second outlet 130*b* of the switching valve 128 to at least partially open. This results in the refrigerant flow from the inlet 131 of the switching valve 128 to the outdoor heat exchanger 138 and restricts or prevents the refrigerant flow from the inlet 131 of the switching valve 128 to the flash tank 112. The controller 160 operates the refrigeration system 200 in the low ambient temperature mode 106 until the ambient temperature 174 increases to be more than or equal to the threshold temperature 176.

In the low ambient temperature mode 106, when the switching valve 128 redirects the refrigerant toward the outdoor heat exchanger 138, the outdoor heat exchanger 138 may receive the refrigerant from the switching valve 128 and transfer heat from the refrigerant to the surrounding outdoor air. This cools the refrigerant before it goes to a next cycle in the system 200. The cooled refrigerant flows through the valve 142 and then to the flash tank 112, operating as a receiver. The liquid refrigerant flows from the flash tank 112 to the valve 120. The valve 120 may control the flow of the refrigerant flowing into the second indoor heat exchanger 122. The indoor heat exchanger 122 may provide conditioned air to the target indoor space when the refrigerant flows through the coils of the first indoor heat exchanger 116. As the refrigerant flows through the coils, it absorbs heat from the indoor space, which cools the air in the indoor target space. This raises the temperature of the refrigerant.

The refrigerant flows from the indoor heat exchanger 122 toward the compressor 124 and the compressor 124 compresses the refrigerant to increase its pressure and/or temperature. The refrigerant then flows to the oil separator 126. The oil separator 126 may separate the oil from the refrigerant received from the compressor 124, return the separated oil back to the compressor, and provide the refrigerant to the switching valve 128. The switching valve 128 may direct the refrigerant toward the outdoor heat exchanger 138. This cycle may continue while the ambient temperature 174 is less than the threshold temperature 176.

Example Refrigeration System Configuration for Providing Cooling for Low Temperature Applications FIGS. 3A and 3B illustrate an embodiment of the refrigeration system 300 configured to provide a low temperature conditioning, e.g., for freezing applications, when operating in the high ambient temperature mode 104 (in FIG. 3A) and in the low ambient temperature mode 106 (in FIG. 3B). The example embodiments illustrated in FIGS. 3A and 3B are substantially similar to the example embodiments illustrated in FIGS. 1A and 1B, respectively, except that, in FIGS. 3A and 3B, the refrigeration system 300 does not include the valve 120, indoor heat exchanger 122, and compressor 124. The rest of the components illustrated in each of FIGS. 2A and 2B are the same or substantially the same components as of those illustrated and described in conjunction with the description of FIGS. 1A and 1B, respectively. Therefore, for brevity, the description of the same components that are described in conjunction of FIGS. 1A and 1B are not repeated here.

FIG. 3A illustrate the flow of the refrigerant through the refrigeration system 300 operating in a high ambient temperature mode 104. In the high ambient temperature mode 104, the refrigerant conduit subsystems 102 through which the refrigerant flows to operate the refrigeration system 300 in the high ambient temperature mode 104 are shown with solid lines, and other refrigerant conduit subsystems 102 that are not in use are shown with dash lines.

FIG. 3B illustrates the flow of the refrigerant through the refrigeration system 300 operating in a low ambient temperature mode 106. In the low ambient temperature mode 106, the refrigerant conduit subsystems 102 through which the refrigerant flows to operate the refrigeration system 300 in the low ambient temperature mode 106 are shown with solid lines, and other refrigerant conduit subsystems 102 that are not in use are shown with dash lines. The refrigeration system 300 may be configured as shown in each of FIGS. 3A and 3B or in any other suitable configuration. For example, the refrigeration system 300 may include additional components or may omit one or more components shown in each of FIGS. 3A and 3B. The refrigeration system 300 is controlled by the controller 160.

In operation, the controller 160 receives the ambient temperature 174 from the temperature sensor circuit 140 and determines whether the ambient temperature 174 is less than the threshold temperature 176. In response to determining that the ambient temperature 174 is more than or equal to the threshold temperature 176, the controller 160 initiates the high ambient temperature mode 104 and, in response, the refrigerant flows through the system 300 as described with respect to FIG. 3A. Otherwise, the controller 160 initiates the low ambient temperature mode 106, and in response, the refrigerant flows through the system 300 as described with respect to FIG. 3B.

Operating in High Ambient Temperature Mode

Referring to FIG. 3A, when the controller 160 operates the refrigeration system 300 in the high ambient temperature mode 104, the refrigerant begins its flow through the system similar to the flow described with respect to the high ambient temperature mode 104 as described in FIG. 1A, except flowing through the valve 120, indoor heat exchanger 122, and compressor 124. In the high ambient temperature mode 104, the general operational flow remains similar to the operational flow of high ambient temperature mode 104 described in conjunction with FIG. 1A.

In operation, the controller 160 may communicate the second electronic signal 170*b* to the switching valve 128 to direct the flow path of the refrigerant from the switching valve 128 toward the flash tank 112 (via the check valve 132). The second electronic signal 170*b* may cause the first outlet 130*a* of the switching valve 128 to at least partially open and the second outlet 130*b* of the switching valve 128 to at least partially close. This results in the refrigerant flow from the inlet 131 of the switching valve 128 to the flash tank 112 (and the check valve 132) and restrict or prevent the refrigerant flow from the inlet 131 to the outdoor heat exchanger 138. The refrigerant is separated into vapor and liquid forms within the flash tank 112. The vapor refrigerant is superheated in the suction heat exchanger 134 and gaseous refrigerant is provided to the FTV compressor 136. The FTV compressor 136 compresses the refrigerant to a higher pressure and the high-pressured vapor refrigerant is directed toward the outdoor heat exchanger 138.

The outdoor heat exchanger 138 releases heat from the refrigerant into the outdoor environment. The cooled refrigerant from outdoor heat exchanger 138 flows to the valve 142 to reduce the pressure of the refrigerant received from the outdoor heat exchanger 138 before it reaches the flash tank 112. In the flash tank 112, the refrigerant is separated again into vapor and liquid. The liquid refrigerant from the flash tank 112 may flow toward the valve 114 to direct the refrigerant to the second indoor heat exchanger 116 to provide cooling demand (e.g., freezing applications) to the target space as required. This cycle may continue while the ambient temperature 174 is higher than or equal to the threshold temperature 176. The controller 160 operates the refrigeration system 300 in the high ambient temperature mode 104 until the ambient temperature 174 reduces to be less than the threshold temperature 176.

Operating in Low Ambient Temperature Mode

Referring to FIG. 3B, when the controller 160 operates the refrigeration system 300 in the low ambient temperature mode 106, the refrigerant begins its flow through the system similar to the flow as in the low ambient temperature mode 106 described with respect to FIG. 1B, except flowing through the valve 120, indoor heat exchanger 122, and compressor 124. In the high ambient temperature mode 104, the general operational flow remains similar to the operational flow of the high ambient temperature mode 104 described in conjunction with FIG. 1B.

In operation, the controller 160 may communicate a first electronic signal 170*a* to the switching valve 128 to direct the flow of the refrigerant from the switching valve 128 toward the outdoor heat exchanger 138. In this way, the switching valve 128 (and the refrigerant flowing from the switching valve 128) may bypass the FTV compressor 136. The first electronic signal 170*a* may cause the first outlet 130*a* of the switching valve 128 to at least partially close and the second outlet 130*b* of the switching valve 128 to at least partially open. This results in the refrigerant flow from the inlet 131 of the switching valve 128 to the outdoor heat exchanger 138 and restricts or prevents the refrigerant flow from the inlet 131 of the switching valve 128 to the flash tank 112. The controller 160 operates the refrigeration system 300 in the low ambient temperature mode 106 until the ambient temperature 174 increases to be more than or equal to the threshold temperature 176.

In the low ambient temperature mode 106, when the switching valve 128 redirects the refrigerant toward the outdoor heat exchanger 138, the outdoor heat exchanger 138 may receive the refrigerant from the switching valve 128 and transfer heat from the refrigerant to the surrounding outdoor air. This cools the refrigerant before it goes to a next cycle in the system 300. The cooled refrigerant flows through the valve 142 and then to the flash tank 112, operating as a receiver.

The liquid refrigerant flows from the flash tank 112 to the valve 114. The valve 114 may control the flow of the refrigerant flowing int the indoor heat exchanger 116. The indoor heat exchanger 116 may provide conditioned air to the target indoor space when the refrigerant flows through the coils of the indoor heat exchanger 116. As the refrigerant flows through the coils, it absorbs heat from the indoor space, which cools the air in the indoor target space. This raises the temperature of the refrigerant. The refrigerant flows from the indoor heat exchanger 116 toward the compressor 118 which compresses the refrigerant to increase its pressure and/or temperature. The refrigerant then flows to the oil separator 126.

The oil separator 126 may separate the oil from the refrigerant received from the compressor 118, return the separated oil back to the compressor, and provide the refrigerant to the switching valve 128. The switching valve 128 may direct the refrigerant toward the outdoor heat exchanger 138. This cycle may continue while the ambient temperature 174 is less than the threshold temperature 176.

Example Refrigeration System Configuration with an Additional Ejector Component

FIG. 4 illustrates an embodiment of the refrigeration system 400 with the additional ejector 410. The ejector 410 may be a passive device or an active device to be controlled by the controller 160. For example, the ejector 410 may be a motive ejector, a two-phase ejector, or a liquid-vapor ejector, and is generally configured to compress a low-pressure refrigerant flow. The ejector 410 may be fluidly coupled to the refrigerant conduit subsystems 102. The ejector 410 may be positioned downstream of the outdoor heat exchanger 138 and the indoor heat exchanger 122. The ejector 410 may receive the refrigerant from the outdoor heat exchanger 138 and the indoor heat exchanger 122. The ejector 410 may reduce the pressure of the refrigerant by mixing a high-pressure refrigerant received from the outdoor heat exchanger 138 with a low-pressure refrigerant received from the indoor heat exchanger 122. The ejector 410 may direct the refrigerant with the reduced pressure toward the flash tank 112. The example configuration of refrigeration system 400 of FIG. 4 is substantially similar to the example configuration illustrated in FIG. 1A, except that, in FIG. 4, the refrigeration system 400 includes the additional ejector 410. The rest of the components illustrated in each of FIG. 4 are the same or substantially the same components as of those illustrated and described in conjunction with the description of FIGS. 1A, respectively. Therefore, for brevity, the description of the same components that are described in conjunction of FIG. 1A are not repeated here.

FIG. 4 illustrates the flow of the refrigerant through the refrigeration system 400 operating in a high ambient temperature mode 104 similar to the high ambient temperature mode 104 described in FIG. 1A. In FIG. 4, the refrigerant conduit subsystems 102 through which the refrigerant flows to operate the refrigeration system 400 in a high ambient temperature mode 104 are shown with solid lines, and other refrigerant conduit subsystems 102 that are not in use are shown with dash lines. The inbound and outbound lines associated with the ejector 410 are shown with dash lines to indicate that the ejector 410 is optional. However, in embodiments where the ejector 410 is implemented, the refrigerant may flow through the ejector 410 as described herein. For example, when the refrigeration system 400 operates in the high ambient temperature mode 104 and the ejector 410 is implemented, the ejector 410 may reduce the load on the compressors by mixing the high-pressure refrigerant received from the outdoor heat exchanger 138 with the low-pressure refrigerant received from the indoor heat exchanger 122.

In operation, the controller 160 may monitor the ambient temperature 174 detected and received from the temperature sensor circuit 140. The controller 160 may receive the ambient temperature 174 from the temperature sensor circuit 140 and determine whether the detected ambient temperature 174 is less than a threshold temperature 176. In response to determining that the detected ambient temperature 174 is more than the threshold temperature 176, the controller 160 may initiate operating the refrigeration system 400 in the high ambient temperature mode 104, and in response, the refrigerant flows through the system 400 as described with respect to FIG. 4.

In the high ambient temperature mode 104, the controller 160 controller 160 may communicate second electronic signal 170*b* to the switching valve 128 to direct the flow path of the refrigerant from the switching valve 128 toward the flash tank 112 (via the check valve 132). The second electronic signal 170*b* may cause the first outlet 130*a* of the switching valve 128 to at least partially open and the second outlet 130*b* of the switching valve 128 to at least partially close. This results in the refrigerant flow from the inlet 131 of the switching valve 128 to the flash tank 112 (and the check valve 132) and restrict or prevent the refrigerant flow from the inlet 131 to the outdoor heat exchanger 138. The controller 160 operates the refrigeration system 400 in the high ambient temperature mode 104 until the ambient temperature 174 reduces to be less than the threshold temperature 176.

In high ambient temperature mode 104, when the switching valve 128 redirects the refrigerant toward the flash tank 112 (via the check valve 132), the refrigerant enters the flash tank 112, where it is separated into vapor and liquid. The liquid refrigerant collects at the bottom of the flash tank 112 and is then directed toward the first indoor heat exchanger 116 and the second indoor heat exchanger 122 to maintain the cooling demands (e.g., for freezing and refrigeration applications) to the target spaces as required. The vapor refrigerant, accumulated at the top of the flash tank 112, is directed to the suction heat exchanger 134. The vapor refrigerant is superheated in the suction heat exchanger 134 and gaseous refrigerant is provided to the FTV compressor 136. The FTV compressor 136 compresses the refrigerant to a higher pressure and the high-pressured vapor refrigerant is directed toward the outdoor heat exchanger 138.

The outdoor heat exchanger 138 releases heat from the refrigerant into the outdoor environment. The cooled refrigerant from outdoor heat exchanger 138 flows to the valve 142 to reduce the pressure of the refrigerant received from the outdoor heat exchanger 138 before it reaches the flash tank 112. Additionally, the refrigerant from the outdoor heat exchanger 138 and the indoor heat exchanger 122 is provided to the ejector 410. The ejector 410 reduces the pressure of the received refrigerant and provide the refrigerant to the flash tank 112. In the flash tank 112, the refrigerant is separated again into vapor and liquid phases, similar to that described above.

The vapor refrigerant from the flash tank 112 may flow toward the suction heat exchanger 134 to continue the cooling the refrigerant via the FTV compressor 136 and the outdoor heat exchanger 138. The liquid refrigerant from the flash tank 112 may flow toward the valves 114 and 120 to distribute the refrigerant to the first indoor heat exchanger 116 and the second indoor heat exchanger 122, respectively, to provide cooling demands (e.g., for freezing and refrigeration applications) to the respective target spaces as required. This cycle may continue while the ambient temperature 174 is higher than or equal to the threshold temperature 176.

Figure 5:
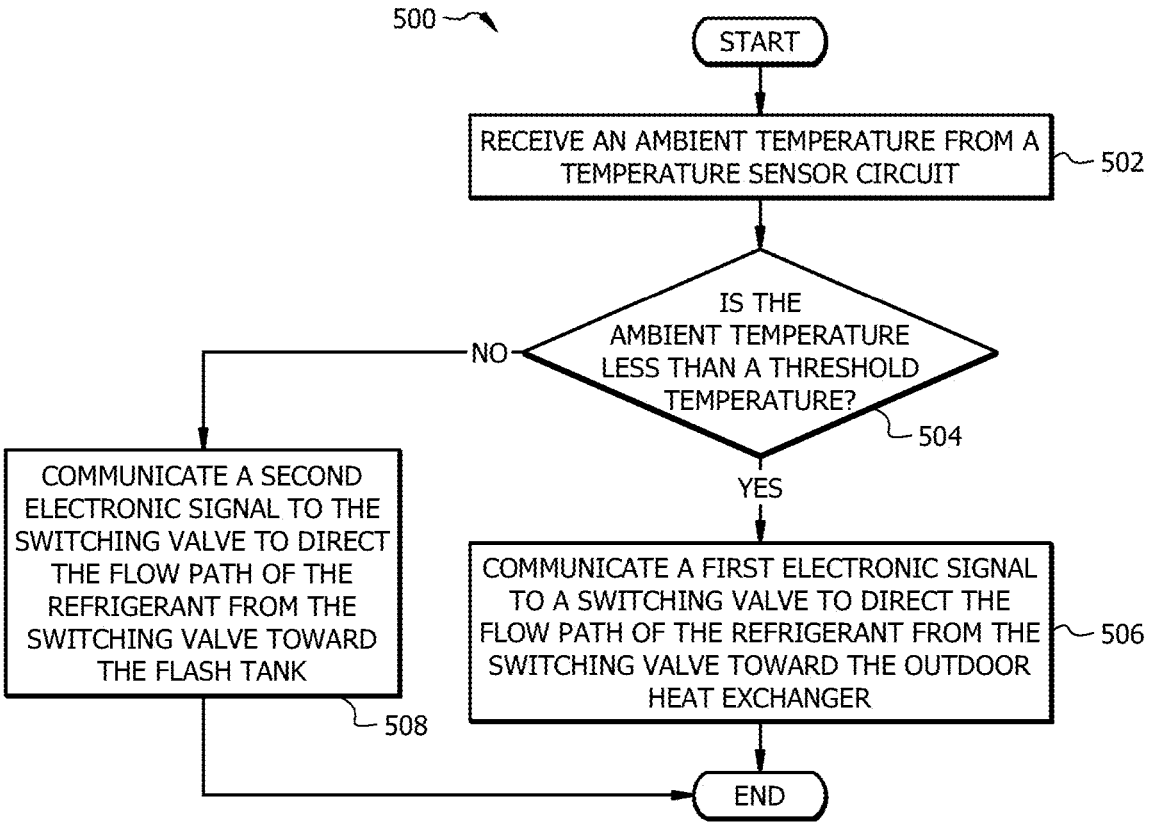
FIG. 5 illustrates a flowchart of an example method of operating any of systems of FIGS. 1 to 4.

Example Method for Decoupling Compressors and Switching Refrigerant Flow Based on Ambient Temperature FIG. 5 illustrates a flowchart of an example method 500 of operating any of the refrigeration systems 100, 200, 300, and 400 of FIGS. 1A to 4, respectively, for decoupling compressors and switching refrigerant flow based on ambient temperature, according to certain embodiments. The method 500 may be performed by the controller 160 (see FIGS. 1A to 4) when one or more processors (e.g., processor 162 of FIGS. 1A-4) execute software instructions (e.g., software program instructions 148) stored in one or more memories (e.g., memory 146 of FIGS. 1A to 4). The method 500 may include operations 502-508.

At operation 502, the controller 160 may receive the ambient temperature 174 from the temperature sensor circuit 140, similar to that described in FIGS. 1A to 4.

At operation 504, the controller 160 determines whether the ambient temperature 174 is less than the threshold temperature 176. If it is determined that the ambient temperature 174 is less than the threshold temperature 176, the method 500 may proceed to the operation 506. Otherwise, the method 500 may proceed to operation 508.

At operation 506, the controller 160 communicates the first electronic signal 170*a* to the switching valve 128 to direct the flow path of the refrigerant from the switching valve 128 toward the outdoor heat exchanger 138, similar to that described in FIGS. 1B, 2B, and 3B.

At operation 508, the controller 160 communicates the second electronic signal 170*b* to the switching valve 128 to direct the flow path of the refrigerant from the switching valve 128 toward the flash tank 112, similar to that described in FIGS. 1A, 2A, 3A, and 4.

Modifications, additions, or omissions may be made to method 500. Method 500 may include more, fewer, or other operations. For example, operations may be performed in parallel or in any suitable order.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system comprising:

a temperature sensor circuit configured to detect an ambient temperature within a vicinity of the refrigeration system;

a first indoor heat exchanger positioned downstream of a flash tank, and configured to absorb heat from surrounding environment via refrigerant received from the flash tank;

a first compressor positioned downstream of the first indoor heat exchanger, and configured to compress the refrigerant received from the first indoor heat exchanger;

an oil separator positioned downstream of the first compressor, and configured to:

separate oil from the refrigerant received from the first compressor; and return the separated oil to the first compressor;

a switching valve positioned downstream of the oil separator, and configured to selectively switch a flow path of the refrigerant between the flash tank and an outdoor heat exchanger depending on the detected ambient temperature; and a controller, communicatively coupled with the temperature sensor circuit and the switching valve, comprising a processor configured to:

receive the detected ambient temperature from the temperature sensor circuit;

determine whether the detected ambient temperature is less than a threshold ambient temperature;

in response to determining that the detected ambient temperature is less than the threshold ambient temperature, communicate a first electronic signal to the switching valve to direct the flow path of the refrigerant from the switching valve toward the outdoor heat exchanger; and in response to determining that the detected ambient temperature is more than or equal to the threshold ambient temperature, communicate a second electronic signal to the switching valve to direct the flow path of the refrigerant from the switching valve toward the flash tank.

2. The refrigeration system of claim 1, further comprising:

a second indoor heat exchanger positioned downstream of the flash tank, and configured to absorb heat from a surrounding environment via the refrigerant received from the flash tank; and a second compressor positioned downstream of the second indoor heat exchanger, and configured to compress the refrigerant received from the second indoor heat exchanger;

wherein the oil separator is further positioned downstream of the second compressor, and further configured to:

separate oil from the refrigerant received from the second compressor; and return the separated oil to the second compressor.

3. The refrigeration system of claim 2, wherein:

the first indoor heat exchanger is configured to maintain a temperature of the refrigerant at a first temperature;

the second indoor heat exchanger is configured to maintain the temperature of the refrigerant at a second temperature; and the first temperature is lower than the second temperature.

4. The refrigeration system of claim 1, further comprising a flash tank vapor compressor positioned downstream of the flash tank, and configured to:

receive vapor refrigerant from the flash tank; and direct the vapor refrigerant toward an outdoor heat exchanger during a high ambient temperature mode, wherein the high ambient temperature mode corresponds to when the detected ambient temperature is more than or equal to the threshold ambient temperature.

5. The refrigeration system of claim 4, wherein, in response to receiving the first electronic signal, the switching valve is further configured to bypass the flash tank vapor compressor.

6. The refrigeration system of claim 1, wherein:

the switching valve comprises a first outlet towards the flash tank and a second outlet towards the outdoor heat exchanger;

the first electronic signal causes the first outlet of the switching valve to at least partially close and the second outlet of the switching valve to at least partially open; and the second electronic signal causes the first outlet of the switching valve to at least partially open and the second outlet of the switching valve to at least partially close.

7. The refrigeration system of claim 1, wherein:

the processor is further configured to selectively switch between a low ambient temperature mode and a high ambient temperature mode depending on the detected ambient temperature;

the low ambient temperature mode corresponds to when the detected ambient temperature is less than a threshold temperature; and the high ambient temperature mode corresponds to when the detected ambient temperature is more than or equal to the threshold temperature.

8. The refrigeration system of claim 1, further comprising an ejector positioned downstream of the first indoor heat exchanger and the outdoor heat exchanger, and configured to:

receive the refrigerant from the first indoor heat exchanger and the outdoor heat exchanger;

reduce a pressure of the refrigerant by mixing a high-pressure refrigerant received from the outdoor heat exchanger with a low-pressure refrigerant received from the indoor heat exchanger; and direct the refrigerant with the reduced pressure toward the flash tank.

9. A method for operating a refrigeration system comprising:

receiving a detected ambient temperature from a temperature sensor circuit;

determining whether the detected ambient temperature is less than a threshold ambient temperature;

in response to determining that the detected ambient temperature is less than the threshold ambient temperature, communicating a first electronic signal to a switching valve to direct a flow path of the refrigerant from the switching valve toward an outdoor heat exchanger; and in response to determining that the detected ambient temperature is more than or equal to the threshold ambient temperature, communicating a second electronic signal to the switching valve to direct the flow path of the refrigerant from the switching valve toward a flash tank.

10. The method of claim 9, further comprising:

separating oil from the refrigerant received from a first compressor and a second compressor, wherein:

the first compressor is positioned downstream of a first indoor heat exchanger and configured to compress the refrigerant received from the first indoor heat exchanger; and the second compressor is positioned downstream of a second indoor heat exchanger and configured to compress the refrigerant received from the second indoor heat exchanger; and returning the separated oil to the first compressor and the second compressor.

11. The method of claim 10, wherein:

the first indoor heat exchanger is configured to maintain a temperature of the refrigerant at a first temperature;

the second indoor heat exchanger is configured to maintain the temperature of the refrigerant at a second temperature; and the first temperature is lower than the second temperature.

12. The method of claim 9, further comprising:

receiving a vapor refrigerant from the flash tank; and directing the vapor refrigerant toward the outdoor heat exchanger during a high ambient temperature mode, wherein the high ambient temperature mode corresponds to when the detected ambient temperature is more than or equal to the threshold ambient temperature.

13. The method of claim 12, wherein, in response to receiving the first electronic signal, the switching valve is further configured to bypass a flash tank vapor compressor positioned downstream of the flash tank.

14. The method of claim 9, wherein:

the switching valve comprises a first outlet towards the flash tank and a second outlet towards the outdoor heat exchanger;

the first electronic signal causes the first outlet of the switching valve to at least partially close and the second outlet of the switching valve to at least partially open; and the second electronic signal causes the first outlet of the switching valve to at least partially open and the second outlet of the switching valve to at least partially close.

15. A controller of a refrigeration system, the controller comprising a processor configured to:

receive a detected ambient temperature from a temperature sensor circuit;

determine whether the detected ambient temperature is less than a threshold ambient temperature;

in response to determining that the detected ambient temperature is less than the threshold ambient temperature, communicate a first electronic signal to a switching valve to direct a flow path of a refrigerant from the switching valve toward an outdoor heat exchanger; and in response to determining that the detected ambient temperature is more than or equal to the threshold ambient temperature, communicate a second electronic signal to the switching valve to direct the flow path of the refrigerant from the switching valve toward a flash tank.

16. The controller of claim 15, wherein:

oil is separated from the refrigerant received from a first compressor and a second compressor, wherein:

the first compressor is positioned downstream of a first indoor heat exchanger and configured to compress the refrigerant received from the first indoor heat exchanger; and the second compressor is positioned downstream of a second indoor heat exchanger and configured to compress the refrigerant received from the second indoor heat exchanger; and the processor is further configured to return the separated oil to the first compressor and the second compressor.

17. The controller of claim 16, wherein:

the first indoor heat exchanger is configured to maintain a temperature of the refrigerant at a first temperature;

the second indoor heat exchanger is configured to maintain the temperature of the refrigerant at a second temperature; and the first temperature is lower than the second temperature.

18. The controller of claim 15, wherein:

vapor refrigerant is received from the flash tank; and the vapor refrigerant is directed toward the outdoor heat exchanger during a high ambient temperature mode, wherein the high ambient temperature mode corresponds to when the detected ambient temperature is more than or equal to the threshold ambient temperature.

19. The controller of claim 18, wherein, in response to receiving the first electronic signal, the switching valve is further configured to bypass a flash tank vapor compressor positioned downstream of the flash tank.

20. The controller of claim 15, wherein:

the switching valve comprises a first outlet towards the flash tank and a second outlet towards the outdoor heat exchanger;

the first electronic signal causes the first outlet of the switching valve to at least partially close and the second outlet of the switching valve to at least partially open; and the second electronic signal causes the first outlet of the switching valve to at least partially open and the second outlet of the switching valve to at least partially close.

* * * * *